US006079172A

United States Patent [19]

Chenel

[11] Patent Number: 6,079,172

[45] Date of Patent: Jun. 27, 2000

[54] DIVIDING ELEMENT IN PANEL FORM TO PRODUCE PARTITIONS AND PRESENTATION FACILITIES FOR TEMPORARY DISPLAYS

[76] Inventor: Guy Gilbert Chenel, 1 rue Marcel Lovau, 92100 Boulogne, France

[21] Appl. No.: 09/143,221

[22] Filed: Aug. 28, 1998

[30] Foreign Application Priority Data

Sep. 2, 1997 [FR] France ..... 97 10897
Jun. 8, 1998 [FR] France ..... 98 07166

[51] Int. Cl.[7] ..... E04H 1/00

[52] U.S. Cl. ..... 52/239; 52/238.1; 52/243; 52/783.17; 52/783.19; 52/793.11; 52/799.11; 52/800.12

[58] Field of Search ..... 52/239, 783.17, 52/783.19, 793.11, 799.11, 800.12, 243, 238.1

[56] References Cited

U.S. PATENT DOCUMENTS

| | | | |
|---|---|---|---|
| 4,404,776 | 9/1983 | Ball et al. | 52/29 |
| 4,744,184 | 5/1988 | Kramer | 52/227 |
| 5,501,051 | 3/1996 | Harlan | 52/646 |

FOREIGN PATENT DOCUMENTS

| | | |
|---|---|---|
| 0 026 166 | 4/1981 | European Pat. Off. . |
| 2 105 000 | 4/1972 | France . |
| 2 435 772 | 4/1980 | France . |
| 2 689 284 | 10/1993 | France . |
| 1 589 715 | 5/1981 | United Kingdom . |
| 2 278 861 | 12/1994 | United Kingdom . |

*Primary Examiner*—Christopher T. Kent
*Assistant Examiner*—Nkeisha J. Maddox
*Attorney, Agent, or Firm*—Baker & Daniels

[57] ABSTRACT

Dividing element in panel form to produce partitions and presentation facilities for temporary displays.

Dividing element in the form of a panel placed upright and intended to be detachably fitted to other elements to form a partition or division, specifically for temporary displays.

The element is composed of a thin structure equipped with deformations (10, 11) emerging from the principal plane (P) of the panel in the thickness direction, having a repetitive shape in at least one direction of the principal plane (P), the tops of the deformations comprising elementary surfaces (202) situated at least partially in an auxiliary plane (PA1, PA2) corresponding to one face of the element and of a screen (12) in at least one auxiliary plane (PA1, PA2).

14 Claims, 7 Drawing Sheets

DIVIDING ELEMENT IN PANEL FORM TO PRODUCE PARTITIONS AND PRESENTATION FACILITIES FOR TEMPORARY DISPLAYS

The present invention concerns a dividing element in the form of a panel placed upright and intended to be detachably fitted to other elements to form a partition, specifically for temporary displays The techniques for construction of partitions for temporary displays, and more particularly for exhibitions, must fulfil several functions:

physically isolate two spaces by constituting vertical divisions sufficiently difficult to cross and sufficiently resistant to the mechanical forces usually resulting from their use by the public:

allow couplings of objects to be exhibited;

achieve visual isolation of spaces;

allow the coupling of objects to be exhibited on each of their faces.

In the current state of the art, embodiments of temporary partitions insufficiently or incompletely meet these requirements. They are most often achieved by the assembly of standardised and prefabricated elements according to two different construction techniques, resulting in partitions produced by modular extruded aluminium systems.

The purpose of the present invention is to remedy these deficiencies and to provide a dividing element allowing the production of smooth partitions with one or two faces arranged according to the conventional angles of planes, or multi-purpose presentation facilities with one face, either isolated or integrated in the partitions, which is rigid and offers the solidity and stability necessary for such partitions, which is easy and simple to fit/dismantle, easy to transport/maintain/store, is compact, enables objects to be exhibited to be easily and simply coupled, the couplings to be modified without visibly altering the surfaces, the nature and quality of visual screens and their polychromaticity to be varied, other complementary elements to be easily added to the divisions, such as shelf holders, mouldings, ceilings, and lighting system, to facilitate the installation of internal electric cables, electric power supplies on the partitions, the placement of facings, linings, or visual screens, and most notably in such a way that the partitions represent an impeccable appearance, with one or two screens extended over the faces, which are perfectly parallel to the faces of the partition and are at no risk of being damaged under the effect of an accidental collapse.

This element must furthermore offer great reliability and permit economies of Investment and use of structures for maintenance purposes as well, offer a satisfactory fire resistance, and permit recycling of the component elements.

To this end, the invention concerns a panel element of the type defined above, characterised by the first claim.

The panel element according to the invention is prefabricated and modular. It is compatible with the component elements of modular aluminium structures.

It comprises a partition with one or two faces or a presentation facility allowing conventional couplings.

The invention thus combines two types of elements of a highly specialised and complementary nature, first of all elements with a highly durable and therefore easily shock-absorbed structure. It refers to panels, crosspieces, and posts. These elements are easy to transport and store in limited volume, and the fact of their appearance being altered by multiple assembly, dismantling, and transport operations is of no importance. The second part is composed of thin screens comprising low-cost limited-use or disposable sheets offering easy installation and elegantly masking the structures which often have the appearance defects cited above.

The element allows the production of partitions with an apparent thickness near that of joinery partitions (around 50 mm). This thickness is of importance for stability and rigidity in the vertical position. It also enables smooth partitions to be produced. The panel elements according to the invention, however, can be stacked very easily thanks to the overlapping of repetitive deformations which correspond from one panel to another.

Other advantageous characteristics of the invention are specified in the dependent claims.

The present invention will be described below in more detail with reference to the attached drawings in which.

Figure 1:
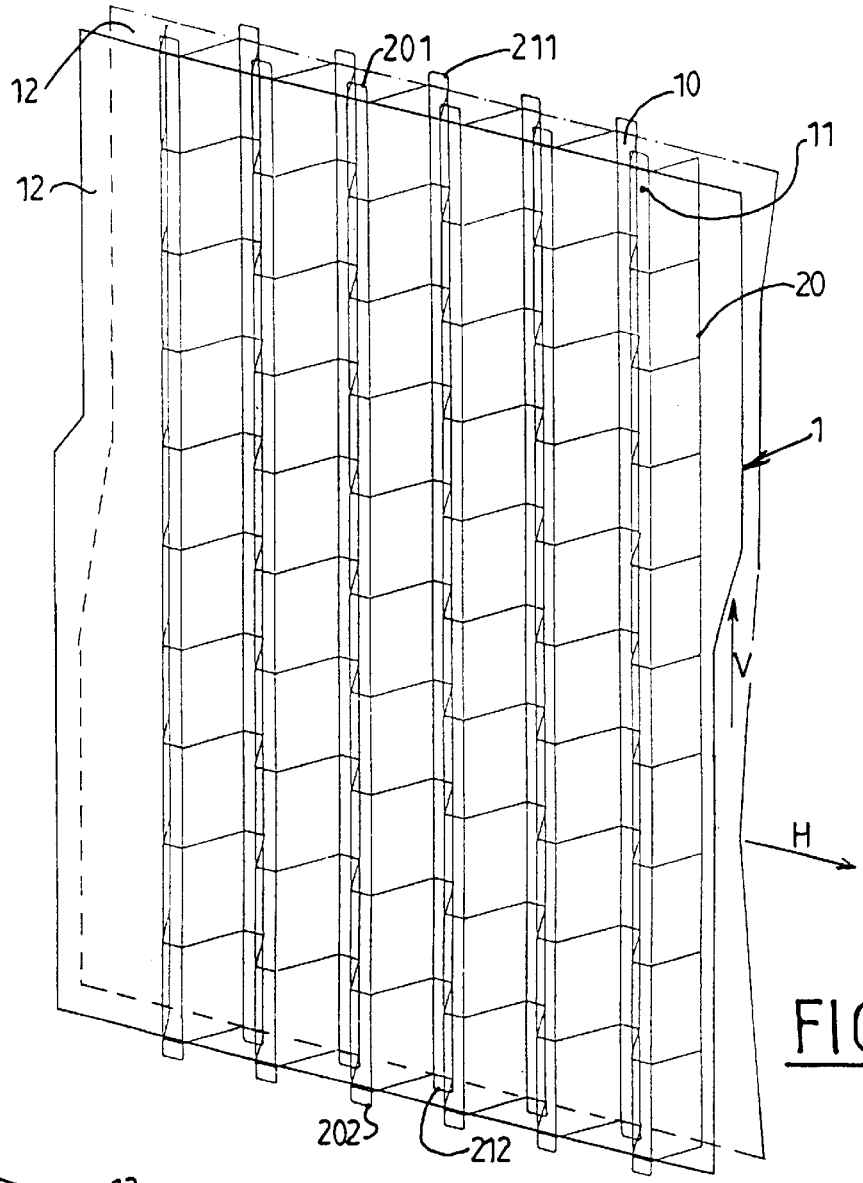
FIG. 1 is a perspective view of a dividing element according to the invention without the visual screen(s)
Figure 2:
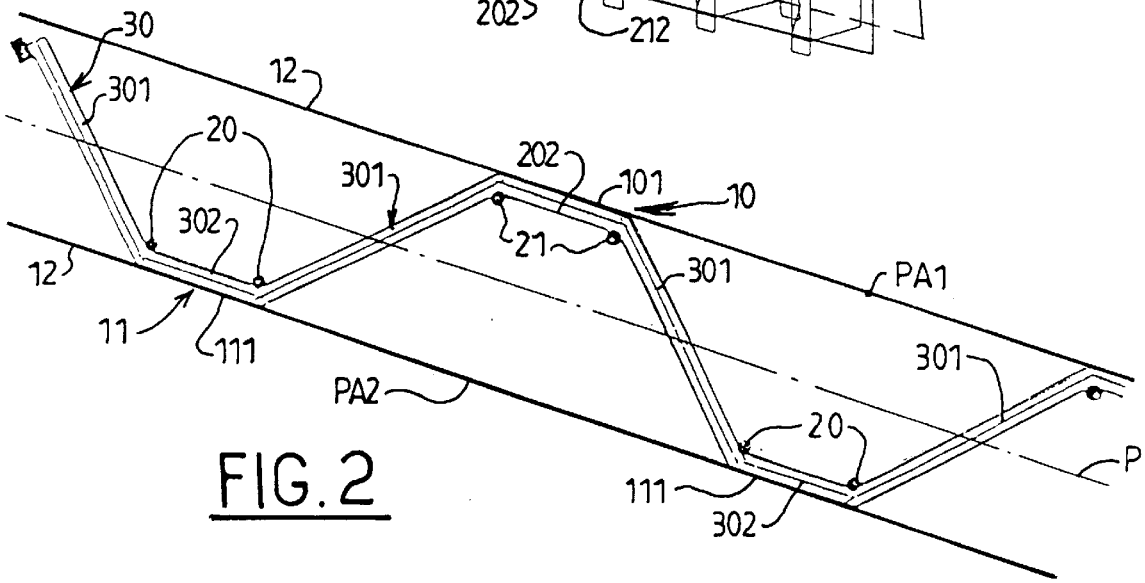
FIG. 2 is a partial horizontal section view at different scale of the element shown in FIG. 1.
Figure 3:
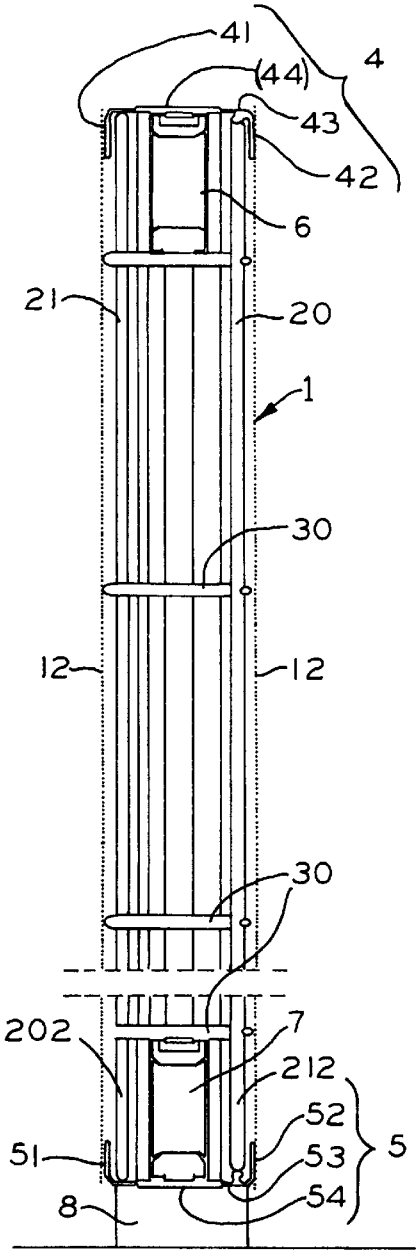
FIG. 3 is a vertical section view of a dividing element according to FIG. 1, with both visual screens.

According to FIGS. 1, 2, 3, the invention concerns a dividing element 1 in the form of a panel placed upright. This element is intended to be detachably fitted, as will be subsequently seen, to other such elements with, where necessary, the interposition of uprights to form a partition and/or presentation facility.

This element 1 is composed of a thin structure equipped with deformations 10, 11 emerging from principal plane P of the panel (FIG. 2). These deformations 10, 11 produced in the thickness of the dividing element have a repetitive shape in one direction of the principal plane. According to FIG. 1, this shape is repetitive in the horizontal direction, with the overall shape being preserved along a cylindrical profile in the vertical direction (according to FIG. 1).

The horizontal direction and vertical direction respectively bear the references H and V. The tops 101, 111 of the deformations comprise elementary plane surfaces or near-plane surface situated in one or two auxiliary parallel planes PA1, PA2 on each side of principal plane P of the panel. These auxiliary planes are preferably but not necessarily equidistant from principal plane P.

Auxiliary planes PA1, PA2 forming the face(s) of the panel are equipped with screen 12 represented by a dotted line.

The framework of dividing element 1 is formed by a first group of rods 20, 21 parallel to the first direction (vertical direction V), i.e. straight and undeformed, and by a second group of rods 30, all being identical, situated in the horizontal planes (plane of FIG. 2). These rods 30 have an undulating shape (or are formed to this shape) e.g. composed of segments 301 inclined in relation to centreplane P and intermediate segments 302 parallel to centreplane P and corresponding to surface elements 101, 111 (FIG. 2).

According to the embodiment represented in FIGS. 1 and 2, rods 30 of the second family are bent along a polygonal profile into meanders formed from a succession of symmetric trapezia.

Element 1 may be produced from a plane welded structure whose rods 20, 21, 30 are joined flat, rods 20 being welded alternately in a group of two on each side of principal plane P in which rods 30, then still straight, are located. The deformation or shaping of element 1 is then performed to obtain the undulating profile represented in FIGS. 1 and 2.

Curved undulations may replace the broken line undulations. In a general way, element 1 includes repetitive deformations or patterns in one direction or in two directions of the principal plane.

Although this repetition only occurs in FIGS. 1 and 2 in horizontal direction H, repetitive deformations may also be performed in vertical direction V. This will thus result in deformations with repetitive patterns in two directions of principal plane P.

FIG. 1 also shows that the upper ends of rods 20, 21 are preferably joined by a loop 201, 211, as is the case for the lower ends joined by a loop 202, 212. In fact, given the repetitive pattern, there is no difference between the top and bottom of the panel, which is perfectly reversible.

Element 1 is equipped in its upper part and lower part with a shaped member 4, 5. These shaped members may be a priori identical. They refer to U-section shaped members with two side branches 41, 42 and web 43 connecting these two branches. This web is preferably perforated (perforation 44) in order to be lighter and to permit the passage of electric cables inside the partitions.

The shape of shaped members 5 is identical or similar. They comprise two side branches 51, 52 and web 53 preferably equipped with perforation 54.

Also provided in the upper part and lower part is shaped member 6, 7 corresponding to the crosspieces of commercial modular structures. These crosspieces ensure the connection between shape members 4,5 and uprights 8 by means of commercial assembly fixtures. According to another arrangement, the shaped member terminates at each end in feet 61, 71 (FIGS. 4 and 5) enabling them to be fixed in uprights 8 formed by grooved tubular profiles allowing, as shown in the assembly in the FIG. 3, assemblies in different angular positions (45°, 90°, 135°, 180°) and angles complementary to 360°.

Figure 4:
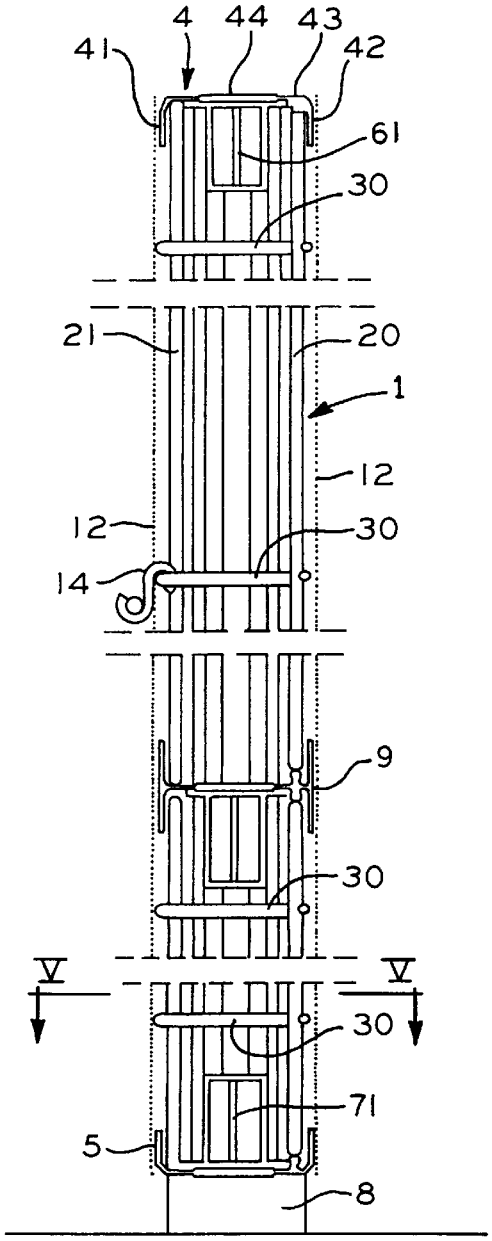
FIG. 4 is a vertical section view of a partition element embodiment version.
Figure 5:
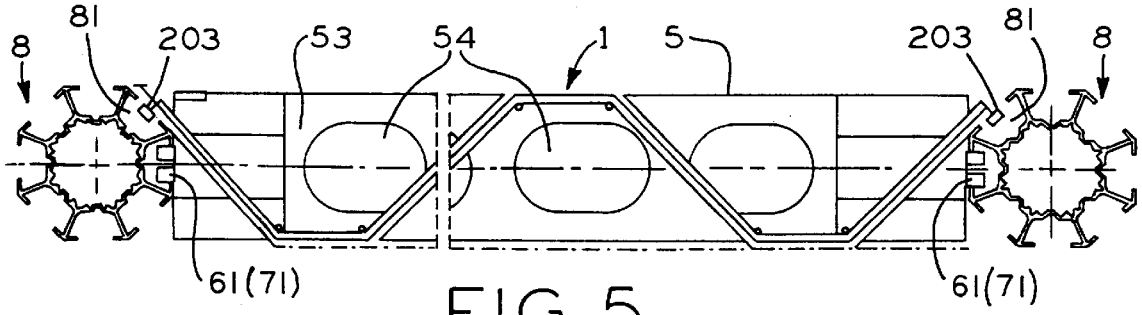
FIG. 5 is a horizontal section view of a partition element along section v—v in FIG. 4, this element being placed between two tubular uprights.

According to FIG. 4, element 1 also comprises intermediate shaped member 9, such as e.g. H-shaped members.

The edges of element 1 are equipped with e.g. a vertical tongue or rod 203 which slides in socket 81 of uprights 8.

Figure 8:
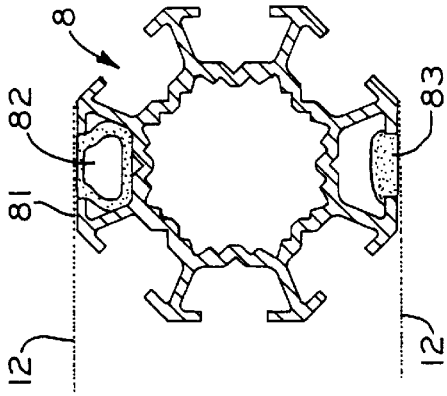
FIG. 8 is a section view at larger scale of a tubular upright and the placement of retainers in their sockets.

FIG. 8 shows an example of upright 8 at larger scale.

Figure 7:
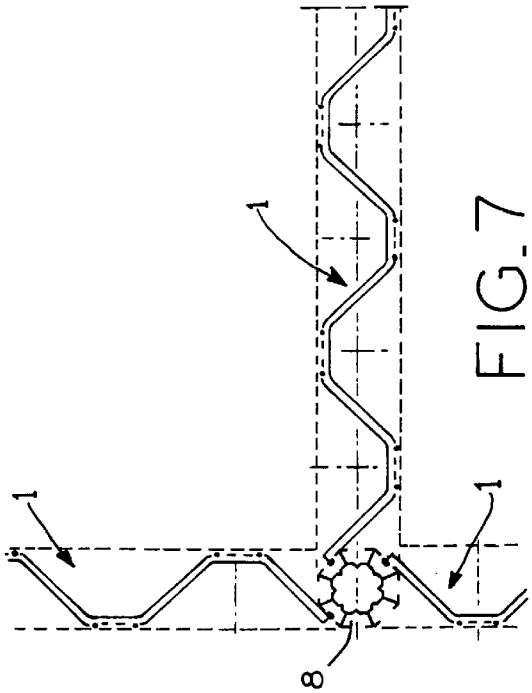
FIG. 7 shows an example of three elements being assembled at right angles to a tubular upright.
Figure 6:
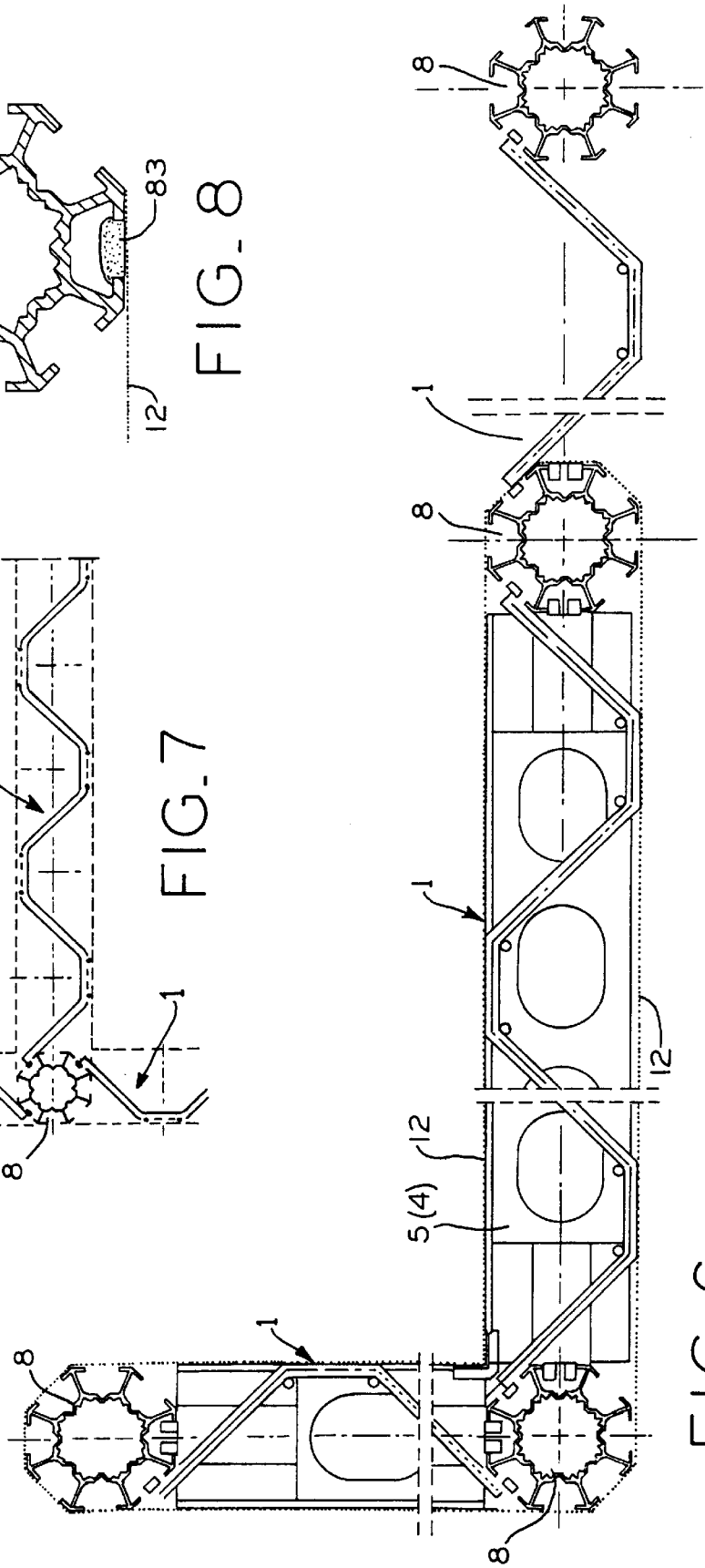
FIG. 6 is a horizontal section view showing a first embodiment example of a partition produced with the elements according to FIGS. 1, 4, and 5.

FIGS. 6 and 7 show horizontal sections of partition embodiments.

According to FIG. 6, a first dividing element 1 is placed on the right between uprights 8 without receiving either an upper or lower shaped member or a facing screen for better understanding of the drawing. The two following uprights 8 receive an element 1 equipped with upper and lower shaped members 5, 4 and screens 12 on both their faces. Left upright 8 receives at right angles another element 1 also equipped with screens on both its faces much like the preceding element.

FIG. 7 shows the assembly of three elements 1 (with screens 12) on an identical tubular upright.

FIG. 8 shows a section view of an Upright 8 whose grooves 81 are equipped with two retainers 82, 83 with different shapes. These two retainers receive, e.g. by coupling or sticking, the vertical edges of screens 12.

Figure 10:
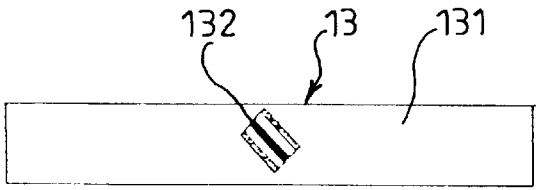
FIG. 10 is a view from above corresponding to FIG. 9.
Figure 9:
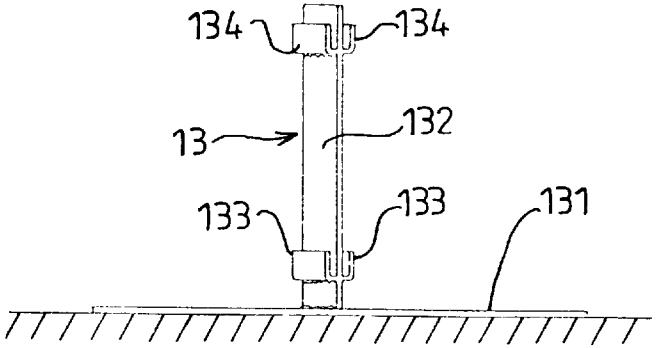
FIG. 9 is a side view of an upright embodiment version according to the invention.

FIGS. 9 and 10 shows another method for assembly and stabilization of elements forming a partition.

Figure 11:
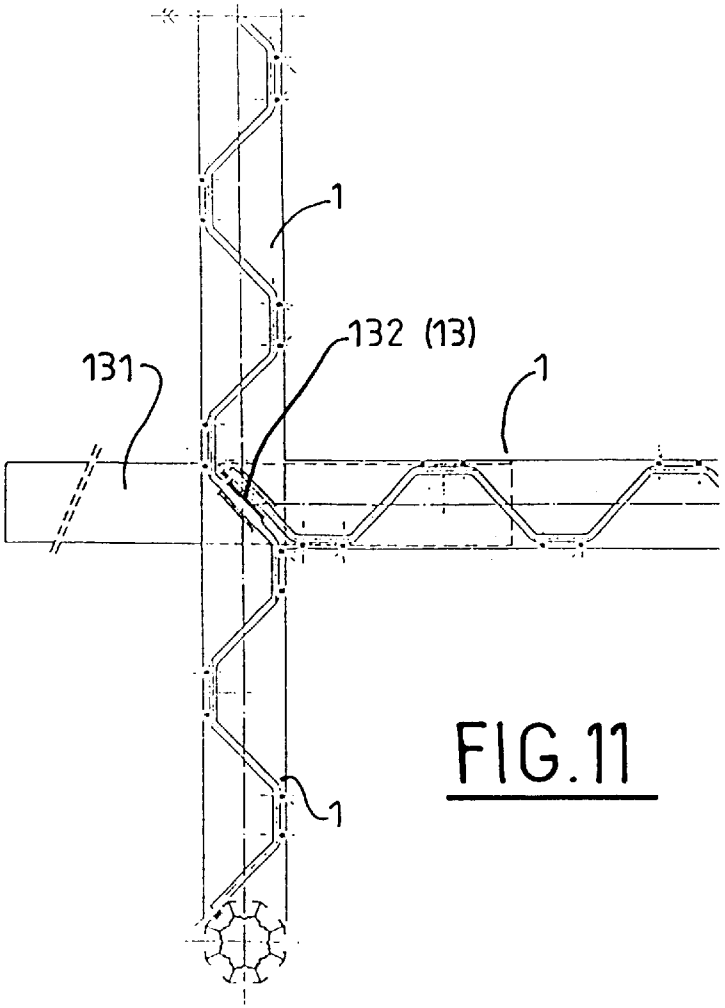
FIG. 11 shows the assembly of two elements by means of an upright according to FIGS. 9 and 10.

According to FIGS. 9 and 10, upright 13 is composed of foot 131 supported on the ground and the body of upright 132 formed by a vertical flat piece of iron inclined in relation to the longitudinal direction of basc 131. The two faces of this body 132 are equipped with brackets 133, 134 to receive the horizontal rods 30 of elements 1, as shown in FIG. 11.

Figure 12:
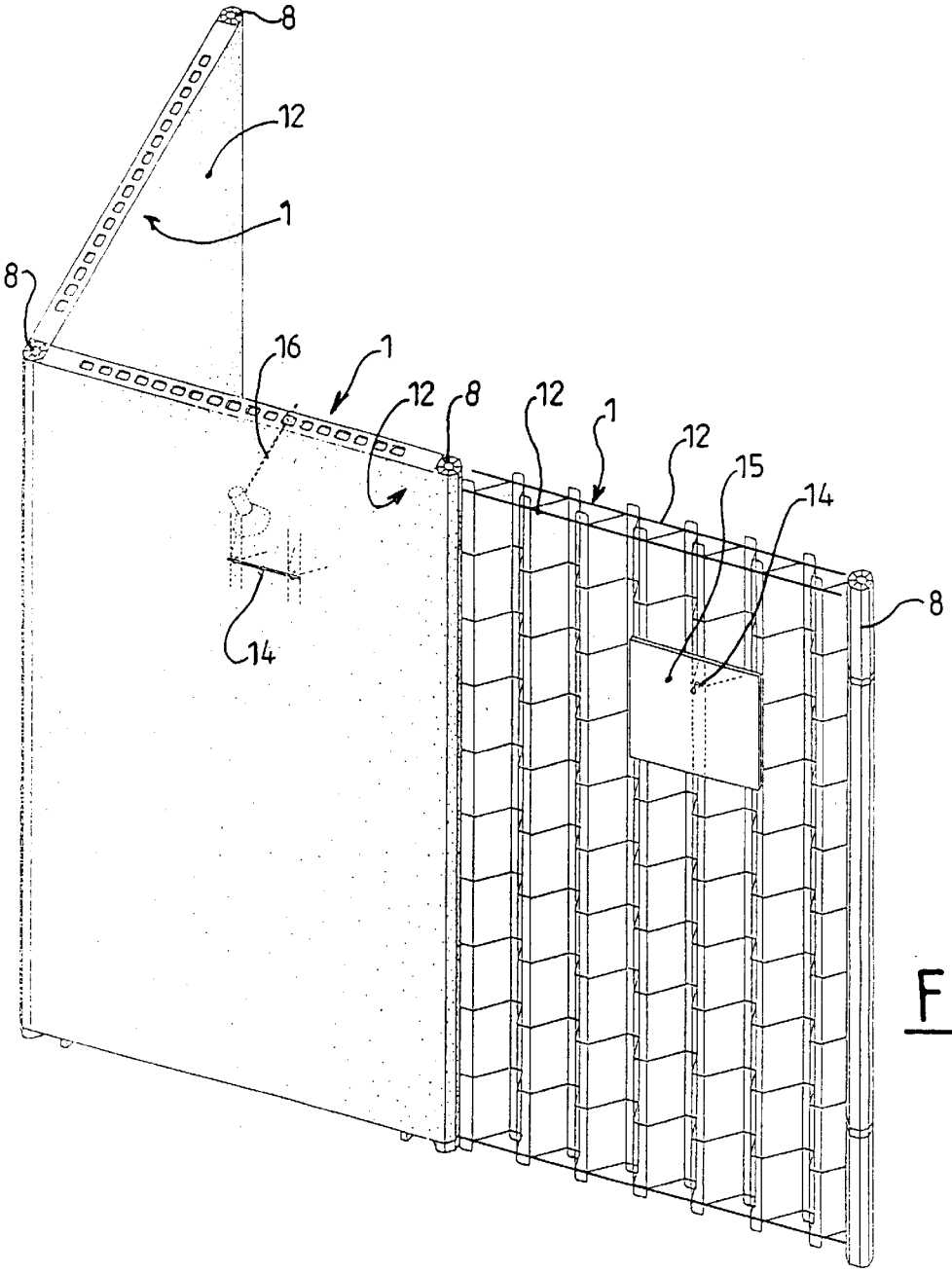
FIG. 12 is a perspective view of a partition produced by three elements as described above being assembled.

FIG. 12 shows a partition produced with three elements according to the invention, showing in perspective the partition in FIG. 6. One of the elements transparently shows the internal structure across screens 12. To facilitate understanding, horizontal crosspieces 4 and 5 have not been included on the right element. This drawing also shows different accessories placed on the partition, such as e.g. hook 14 (see also FIG. 4) hooked to a horizontal rod serving to hook an object, such as e.g. a panel or board.

The second element is equipped with hook 14 and electric reflector 16.

Figure 13:
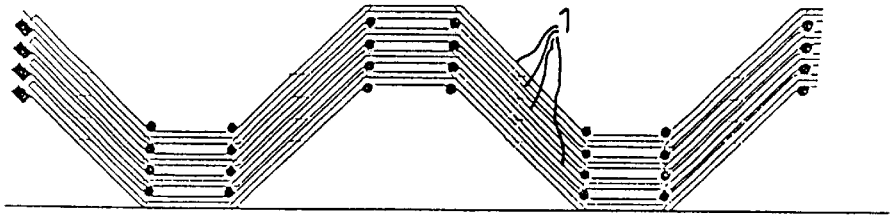
FIG. 13 shows stacking of the dismantled elements without the shaped members and without the screens.

FIG. 13 shows a stack of elements 1 whose screens have been removed. This drawing brings out the considerable space gain by such a stack. Elements 8, 4 and 5 may moreover be placed in trapezoidal troughs.

Figure 16:
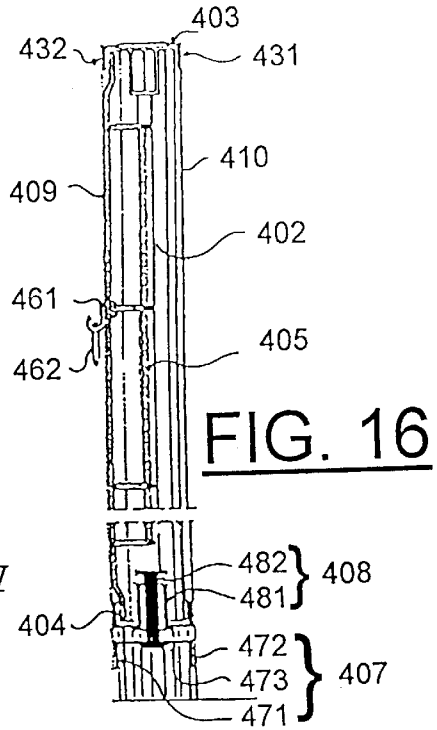
FIG. 16 is a vertical view along section III—III in FIG. 15.
Figure 14:
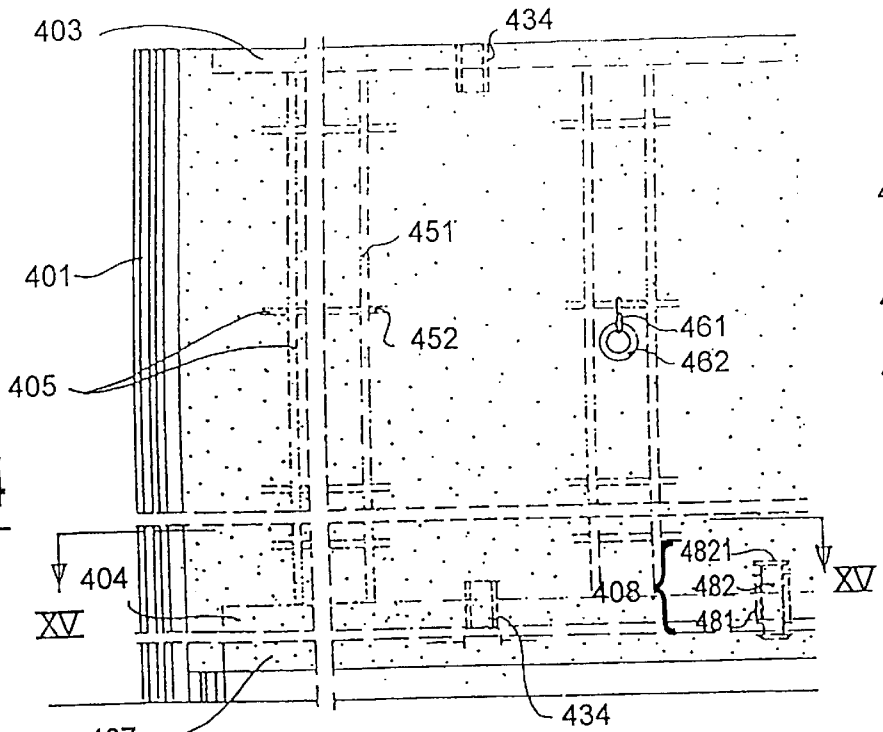
FIG. 14 is a horizontal side view of a method for production of a partition exhibiting an upper fixed crosspiece and a lower moving crosspiece according to the invention.
Figure 15:
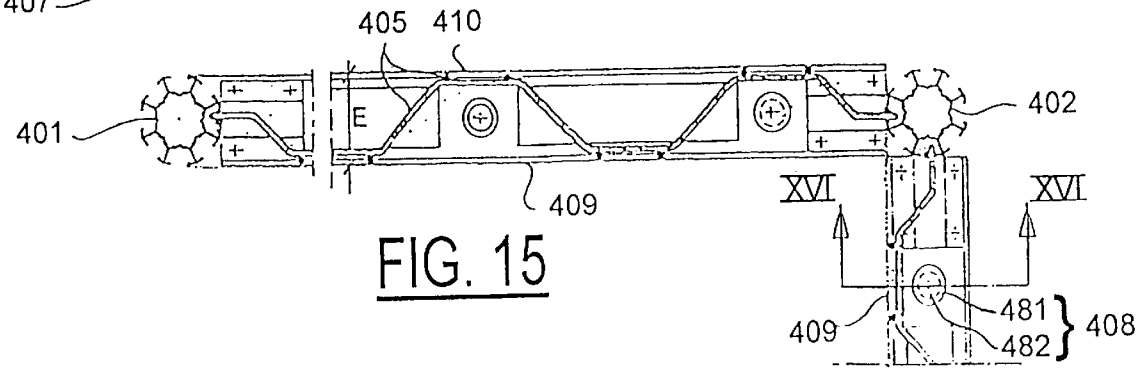
FIG. 15 is a vertical view from above along section II—II of the partition shown in FIG. 14.

According to FIGS. 14, 15, and 16 showing another embodiment example of the invention, the temporary partition is composed of a structure formed from two identical uprights 401, 402 comprising an e.g. grooved shaped member to facilitate assembly of the partitions. In its upper part, the partition includes an upper crosspiece 403 and, in its lower part, a lower crosspiece 404. Crosspieces 403, 404 are integrally connected to uprights 401, 402 by two connection means (not shown), such as screw means acting on spreaders or locking in grooves.

Between uprights 401, 402 and crosspieces 403, 404, the partition structure includes element 405 e.g. in the form of a lattice with vertical 451 and horizontal 452 rods. The horizontal rods have a meandering undulating curve or polygonal profile passing from one side to the other of thickness E of the partition (FIG. 15). These horizontal elements 452 of structure 405 comprise the fixing points for coupling means, such as e.g. hooks 461 and rings 462.

The structure is completed by lower crosspiece 407 moving vertically by guide means. This crosspiece includes vertical guide means 408 composed of sleeves 481 fixed to lower crosspiece 404 and guide rods 482 fixed to moving crosspiece 407. Guide rods 482 e.g. end in abutment 4821 which limits the length of rod 482, i.e. the vertical stroke of moving crosspiece 407, in relation to fixed lower crosspiece 404. According to the example shown, moving crosspiece 407 is placed under lower crosspiece 404. It could wall also be placed over the latter where required for reasons of partition design.

The vertical section view of FIG. 16 clearly shows the shape of guide means 408.

Moving crosspiece 407 preferably has an inverted U-shaped section with two sides 471, 472 separately situated in each of the two vertical planes of the partition faces and a base 473 bearing rods 482. Lower crosspiece 404 also preferably has a U-shaped section like that of upper crosspiece 403. This section is of importance for both fixed crosspieces 403, 404 not only to homogenise the embodiment and means necessary for constitution of the partition, but also, in the example shown, because of the element of structure 405 whose horizontal upper and lower edges are embedded in fixed lower crosspiece 404 and fixed upper crosspiece 403.

Vertical sides 431, 432 of upper crosspiece 403 receive the upper edge of screen 409 or 410 comprising either face of the partition. Screens 409, 410 may be stuck to crosspiece 403.

The lower edge of screens 409, 410 is fixed in the same way, e.g. by sticking, to sides 471, 472 of moving crosspiece 407. Moving crosspiece 407 thus acts by its own weight in such a way as to stretch screens 409, 410. It is also possible to provide elastic springs or studs (not shown) between, on the one hand, a fixed point of the structure, e.g. lower crosspiece 404, and, on the other, moving crosspiece 407 to exert thrust on moving crosspiece 407 in the tension direction of screens 409, 410.

Finally, upper crosspiece 403 and lower crosspiece 404 may include supplementary sleeves 434 similar to guide sleeves 481 of lower crosspiece 404 to receive accessories, such as e.g. spotlamps (not shown) connected from above by a rod end in sleeves 434 of lower crosspiece 404, the electric feed cable passing inside the partition. Sleeves 434 of crosspieces 403, 404 may also serve for the placement of other elements, such as e.g. right angled supports (not shown) to fix cables in front of the partition.

To homogenise fabrication and storage of partitions, it is important that upper and lower crosspieces 403, 404 should be identical, including for the guide means as well, in such a way as to enable the sleeves of the upper crosspiece to be used e.g. as indicated.

Figure 17:
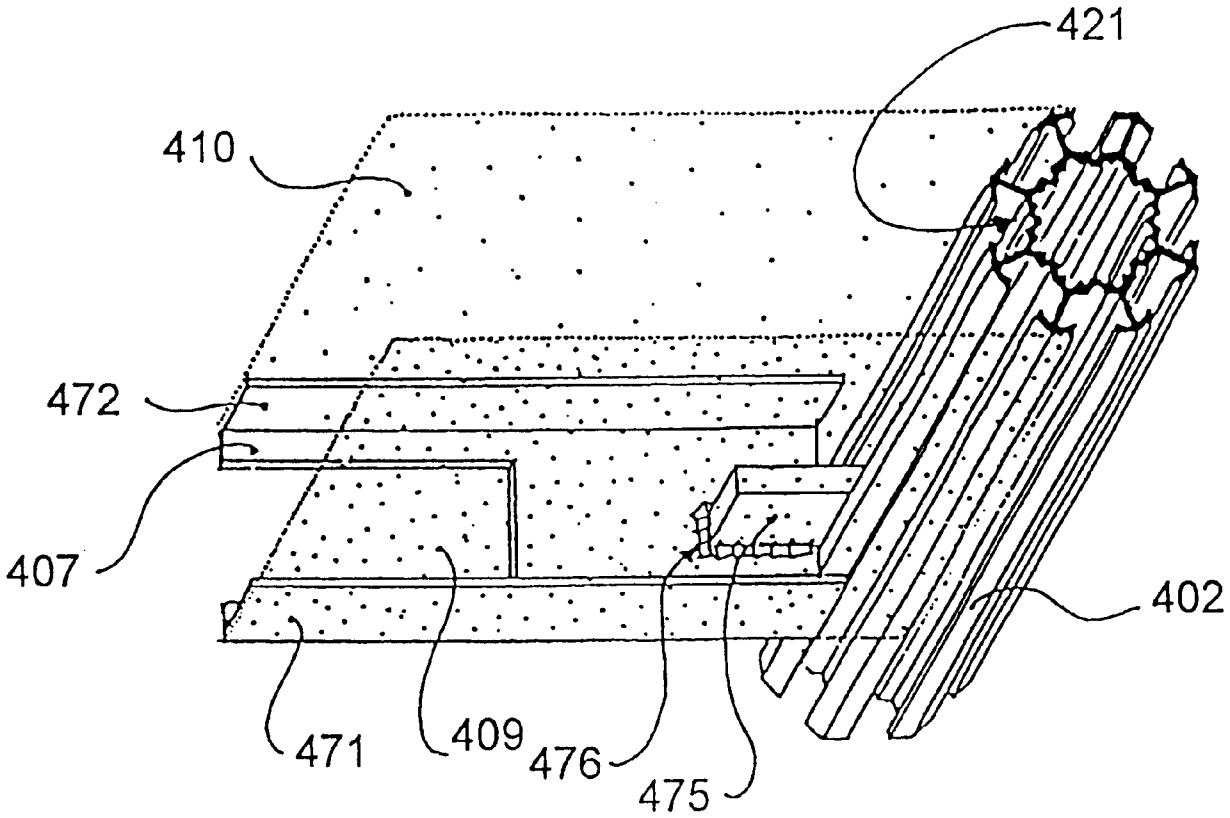
FIG. 17 is a detailed perspective view of one end of a moving crosspiece guided by an upright according to one embodiment example.

FIG. 17 shows another method for production of the guide means. This perspective drawing only shows one part of the partition. Upright 402, identical to that shown in the preceding drawings, thus serves to guide moving crosspiece 407. The guide means are in this case composed of one of the vertical grooves 421 of upright 402, i.e. the groove facing the inside of the partition. Crosspiece 407 includes at each end vertical blade 475 e.g. welded by weld bead 476 to moving crosspiece 407. This blade 475 with a thickness basically corresponding to the thickness (or more specifically the opening) of groove 421 is thus vertically guided in the groove. Because of blade 475, crosspiece 407 cannot pivot around a horizontal axis. The other end of lower crosspiece 407 includes an identical blade sliding in the corresponding groove of the associated upright.

In the example shown in FIG. 17, crosspiece 407 has a U-shaped section inverted in relation to the arrangement used in the preceding embodiment method.

In this case, side edges 471, 472 of moving crosspiece 407 also receive by adhesion or other means the lower edges of side screens 410, 409.

In conclusion, the panel element according to the invention fulfils the general functions on physical and visual partition. It comprises a partition and/or presentation facility with one face. It allows coupling when it is in both partition form and presentation facility form. This element permits the production of partitions exhibiting smooth surfaces, as shown in FIG. 13. The panel element is prefabricated. It has a modular structure compatible with elements of modular aluminium structure and may replace thin panels or rigid joinery panels as currently used.

To produce the panel element, it is possible to start from a flat structure formed from welded rods distributed depending on the repetitive pattern to be achieved. Alternating shifted bending is then performed from the principal plane. The profile given to this shaping may be very different, ranging from a polygonal section to a mixed-line section or a curved section, specifically a sinusoidal curve. The deformations given to the initial flat structure make the panel element have an apparent thickness concretised by the screens covering the faces of the element.

The panel element according to the invention is very rigid because of the deformations. When it is stripped of the screens, it permits stacking in a space-saving and stable manner, specifically during transport. Compared with conventional embodiments, it permits a considerable saving.

Use of the panel element as a support for coupling is very simple. It is sufficient to make a vertical slot in the screen and to fix a hook 14, as described above, to a horizontal rod. Such horizontal rods are fairly numerous over the whole height to permit coupling at the required place.

According to a production method, the element is formed from a structure composed of a sheet of welded steel wires, this sheet being then bent and treated by e.g. electrogalvanising. The wires may also be replaced by small metal laminated shaped members used for the vertical wires or horizontal wires or merely for one of these groups in a total or partial manner. In the simplest case, when the deformation pattern is only repetitive in the horizontal direction, the panel element is stiffened in the direction of its length.

It can also be stiffened in the direction of its width,

According to another version, the structure in composed of a perforated or expanded metal plate in which deformations are made by shaping, bending, or stamping. The structure may also be composed of a rigid composite or plastic material shaped by hot forming/extrusion. The sheet may be perforated, and coupling is then performed in the prefabricated holes or else by nailing or screwing through the screen. The vertical edges of the frameworks are preferably inclined at 45° or parallel to the principal plane to favour fixing of the elements on the posts. These posts are preferably octagonal to permit the arrangement or joining of panels according to a large range of multiple angles of 45°.

The elements are reinforced by a shaped member with a U-shaped section for the upper edge and lower edge. This shaped member is simply fitted on the upper or lower edge of the framework. It is removed for stacking of the panel elements.

Finally, the lower shaped members with a U-shaped section are superelevated to allow some distance in relation to the ground when the panel elements are coupled to the post. This ground clearance allows the passage of generally indispensable electric cables.

The placement of screens on one face or two faces is not especially difficult. These very thin screens are fixed by sticking or other joining means on possibly prepared surfaces or on retainers placed in the grooves of the posts.

In an advantageous manner, the upper ends of the vertical rods are slightly recessed so that the external datum of the upper and lower shaped members capping the upper and lower ends of the frameworks remains precisely in the plane of the most salient elements in order to obtain a homogeneous surface (auxiliary plane PA1, PA2).

I claim:

1. Dividing element in the form of a panel placed upright and intended to be detachably fitted to other elements to form a partition or division, specifically for temporary displays, characterised by:

a thin resistant and reusable structure equipped with deformations emerging from the principal plane of the panel in the thickness direction, having a repetitive shape in at least one direction of the principal plane, the tops of the deformations comprising elementary surfaces situated at least partially in an auxiliary plane corresponding to one face of the element;

a thin screen in at least one auxiliary plane.

2. Dividing element according to claim 1, characterised in that:

it includes at least one shaped member (4, 5) with a U-shaped section and with a width equal to the thickness of the framework and capping at least the upper edge and lower edge of the framework.

3. Dividing element according to claim 1, characterised in that:

the structure includes one fixed upper (lower) crosspiece and one moving lower (upper) crosspiece.

4. Dividing element according to claim 3, characterised in that:

the moving lower crosspiece has a weight sufficient to ensure tension in the screen.

5. Dividing element according to claim 1, characterised in that:

the deformations are symmetric on each side of the principal plane or have a repetitive shape in the horizontal and vertical directions of the panel.

6. Dividing element according to claim 1, characterised in that:

the thin structure has a surface generated by a vertical generatrix resting on a curve with repetitive rounded or polygonal undulations formed from straight segments, specifically segments inclined at 45° in relation to the horizontal direction of the principal plane and connected by segments parallel to the principal plane.

7. Dividing element according to claim 1, characterised in that:

the structure is formed from vertical straight wires and horizontal wires deformed according to the undulations specifically from vertical wires extended by loops joining them by twos in order to serve as supports for the shaped members.

8. Dividing element according to claim 1, characterised in that:

it includes an assembly and stabilisation element (13) formed from a foot (131) and an upright (132) composed of a flat piece of iron equipped with side brackets (133, 134) at the height of the horizontal wires (30) in order to receive on each side the horizontal wires of one or four panel elements joined at an angle on the post (13).

9. Dividing element according to claim 1, characterised in that:

the structure is composed of a wire lattice, sheet of metal, perforated sheet of metal, expanded sheet of metal, or sheet of plastic material.

10. Dividing element in the form of a panel placed upright and intended to be detachably fitted to other elements to form a partition or division, specifically for temporary displays, characterised by:

a thin resistant and reusable structure equipped with deformations emerging from the principal plane of the panel in the thickness direction, having a repetitive shape in at least one direction of the principal plane, the tops of the deformations comprising elementary surfaces situated at least partially in an auxiliary plane corresponding to one face of the element;

a thin screen in at least one auxiliary plane;

wherein the dividing element includes at least one shaped member with a U-shaped section and with a width equal to the thickness of the framework and capping at least the upper edge and lower edge of the framework; and wherein the shaped members with a U-shaped section, specifically those with perforated webs, end in coupling heads intended to enter into the grooves of tubular uprights.

11. Dividing element in the form of a panel placed upright and intended to be detachably fitted to other elements to form a partition or division, specifically for temporary displays, characterised by:

a thin resistant and reusable structure equipped with deformations emerging from the principal plane of the panel in the thickness direction, having a repetitive shape in at least one direction of the principal plane, the tops of the deformations comprising elementary surfaces situated at least partially in an auxiliary plane corresponding to one face of the element;

a thin screen in at least one auxiliary plane;

wherein the structure includes one fixed upper (lower) crosspiece and one moving lower (upper) crosspiece; and a guide means in vertical translation comprising guides fixed on the fixed crosspiece and complementary members integral with the moving crosspiece and sliding in the guides of the fixed crosspiece.

12. Dividing element in the form of a panel placed upright and intended to be detachably fitted to other elements to form a partition or division, specifically for temporary displays, characterised by:

a thin resistant and reusable structure equipped with deformations emerging from the principal plane of the panel in the thickness direction, having a repetitive shape in at least one direction of the principal plane, the tops of the deformations comprising elementary surfaces situated at least partially in an auxiliary plane corresponding to one face of the element;

a thin screen in at least one auxiliary plane;

wherein the structure includes one fixed upper (lower) crosspiece and one moving lower (upper) crosspiece; and wherein the guides and complementary members are composed of vertical sleeves supported by the fixed crosspiece and by rods supported by the moving crosspiece fitted in the sleeves.

13. Dividing element in the form of a panel placed upright and intended to be detachably fitted to other elements to form a partition or division, specifically for temporary displays, characterised by:

a thin resistant and reusable structure equipped with deformations emerging from the principal plane of the panel in the thickness direction, having a repetitive shape in at least one direction of the principal plane, the tops of the deformations comprising elementary surfaces situated at least partially in an auxiliary plane corresponding to one face of the element;

a thin screen in at least one auxiliary plane;

wherein the structure includes one fixed upper (lower) crosspiece and one moving lower (upper) crosspiece; and a guide means is comprised of grooves in the vertical uprights on each side of the partition and that the moving crosspiece includes at each end a guide blade with a thickness corresponding to the width of the groove in order to slide in the latter.

14. Dividing element in the form of a panel placed upright and intended to be detachably fitted to other elements to form a partition or division, specifically for temporary displays, characterised by:

a thin resistant and reusable structure equipped with deformations emerging from the principal plane of the panel in the thickness direction, having a repetitive shape in at least one direction of the principal plane, the tops of the deformations comprising elementary surfaces situated at least partially in an auxiliary plane corresponding to one face of the element;

a thin screen in at least one auxiliary plane; and wherein the vertical edges of the structure are equipped with connection means intended to be fixed in the grooves of tubular posts to which the panel elements are fixed.

* * * * *